US007049576B2

(12) United States Patent
Kato et al.

(10) Patent No.: US 7,049,576 B2
(45) Date of Patent: May 23, 2006

(54) KEYBOARD MUSICAL INSTRUMENT HAVING EASILY INSTALLABLE OPTICAL POSITION TRANSDUCER WITH COUPLER FOR COUPLING OPTICAL MODULATOR TO MOVING OBJECT

(75) Inventors: Tadaharu Kato, Hamamatsu (JP); Shigeru Muramatsu, Hamamatsu (JP); Shigeaki Sato, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 10/199,256

(22) Filed: Jul. 18, 2002

(65) Prior Publication Data

US 2003/0025071 A1 Feb. 6, 2003

(30) Foreign Application Priority Data

Jul. 31, 2001 (JP) ..... 2001-232455

(51) Int. Cl.
*H01J 40/14* (2006.01)

(52) U.S. Cl. ..... 250/221; 84/724; 250/227.22

(58) Field of Classification Search ..... 250/221, 250/227.12, 227.22; 84/724, 20, 21
See application file for complete search history.

(56) References Cited

U.S. PATENT DOCUMENTS

| | | | | |
|---|---|---|---|---|
| 4,351,221 A | | 9/1982 | Starnes | 84/609 |
| 4,488,472 A | * | 12/1984 | Kumano et al. | 84/434 |
| 5,909,028 A | * | 6/1999 | Yamamoto | 250/221 |
| 2001/0007218 A1 | | 7/2001 | Tamaki | 84/20 |

FOREIGN PATENT DOCUMENTS

| | | |
|---|---|---|
| CH | 587 531 | 7/1975 |
| EP | 0 326 969 | 8/1989 |
| JP | 8-44359 | 2/1996 |
| JP | 8-221069 | 8/1996 |
| JP | 8-314461 | 11/1996 |
| JP | 9-68981 | 3/1997 |
| JP | 11-212570 | 8/1999 |

* cited by examiner

*Primary Examiner*—Thanh X. Luu
(74) *Attorney, Agent, or Firm*—Morrison & Foerster LLP

(57) ABSTRACT

An optical position transducer is provided for each of the black/white keys incorporated in a composite keyboard musical instrument; the optical position transducer includes a photo-coupler radiating a light beam, an optical filter moved across the light beam, a recess formed in the black/white key at a proper position where the optical filter is aligned with a target trajectory crossing the light beam and an elastic coupler pressed to an inner surface defining the recess and secured to the optical filter so that a worker assembles the optical filter with the key by inserting the elastic coupler into the recess.

4 Claims, 11 Drawing Sheets

KEYBOARD MUSICAL INSTRUMENT HAVING EASILY INSTALLABLE OPTICAL POSITION TRANSDUCER WITH COUPLER FOR COUPLING OPTICAL MODULATOR TO MOVING OBJECT

FIELD OF THE INVENTION

This invention relates to a data acquisition technology preferable for a moving object on a certain trajectory and, more particularly, to an optical position transducer and a keyboard musical instrument with the optical position transducers for obtaining pieces of music data information.

DESCRIPTION OF THE RELATED ART

Musical instruments are classified into two major categories. Acoustic musical instruments are categorized in the first group. Players give rise to vibrations in the acoustic musical instruments, and the acoustic sound is generated directly from the vibrations. Electronic musical instruments are different from in the sound generating mechanism from the acoustic musical instruments. Players give pieces of music data information representative of attributes of tones to be generated to the electronic musical instruments. The electronic musical instruments analyze the pieces of music data information, and determine the tones. The electronic musical instruments produce an electric signal from the pieces of music data information, and the electric signal is converted to the tones. Thus, the electronic musical instruments per se generate the vibrations for generating the tones, and are categorized in the second group.

There is a compromise between the acoustic musical instrument and the electronic musical instrument, i.e., the two major categories. The compromise is hereinbelow referred to as "composite musical instrument". A player has an option on the process for generating tones. The player gives rise to the vibrations in the composite musical instrument by himself or herself, or gives pieces of music data information to the composite musical instrument for generating vibrations.

An automatic player piano is an example of the composite keyboard musical instrument. The composite keyboard musical instrument is fabricated on the basis of an acoustic piano, and an automatic playing system is combined with the acoustic piano. A pianist may select acoustic tones. When the pianist plays a piece of music through the acoustic tones, he or she disables the automatic playing system, and does not give any piece of music data information to the automatic playing system. The pianist fingers the piece of music on the keyboard. The strings are selectively struck with the hammers, and the acoustic tones are radiated from the vibrating strings. Thus, the pianist gives rise to the vibrations in the automatic player piano for the acoustic tones.

A pianist is assumed to select the automatic playing system. The pianist supplies a set of music data codes to the automatic playing system. The set of music data codes is, by way of example, representative of a previous performance. The pianist may record the previous performance through the recording sub-system incorporated in the automatic playing system. Otherwise, the pianist may purchase a compact disc, in which the set of music data codes has been recorded, in the market. Pieces of music data information representative of the attributes of tones, i.e., pitch names of tones to be generated, loudness, a lapse of time at which each tone is to be generated are stored in the set of music data codes. Thus, the pianist gives pieces of music data information to the automatic player piano. The automatic playing system analyzes the pieces of music data information, and determines a series of tones to be produced. The automatic playing system selectively moves the keys for driving the hammers for rotation. The hammers strike the associated strings. The strings vibrate, and the tones are radiated from the vibrating strings.

The recording sub-system is usually incorporated in the automatic playing system. Pianists record their performances on the keyboard through the recording sub-system. The recording sub-system converts the fingering on the keyboard to a set of music data codes. An array of position transducers is required for the recording sub-system.

A typical example of the position transducer is a combination of photo-couplers and shutter plate. The shutter plates are non-transparent, and are respectively attached to the reverse surfaces of the black/white keys. In other words, the shutter plates downwardly project from the black/white keys toward the key bed. The plural sets of photo-couplers are respectively provided for the shutter plates, and are supported by a bracket on the key bed. The photo-couplers of each set are arranged along the trajectory of the associated shutter plate, and radiate light beams across the trajectories.

Each of the photo couplers consists of a light emitting element and a photo detecting element. The light emitting element is provided on a certain side of the trajectory, and the photo detecting element is on the other side of the trajectory. The photo detecting element is on the optical path for the light beam, and converts the incident light to photo current. While the black/white keys are resting, all the photo-couplers produces the photo current, and are in on-state. Thus, each of the black/white keys at the rest position is represented by the on-state photo couplers of the associated set.

A pianist is assumed to depress a black/white key. The black/white key is sunk, and, accordingly, the shutter plate is downwardly moved along the trajectory. The shutter plate successively interrupts the light beams. When the shutter plate interrupts a light beam, the light beam does not reach the photo detecting element, and any photo current is not produced. Then, the photo coupler is changed to the off-state, and the associated set includes the off-state photo coupler together with the on-state photo couplers. The photo couplers are sequentially changed to the off state with the associated shutter plate on the way to the end position of the associated black/white key.

On the other hand, when the pianist releases the black/white key at the end position, the black/white key starts to return toward the rest position along the trajectory. The shutter plate sequentially vacates the optical paths. When the shutter plate vacates the optical path of a photo coupler, the light beam is incident on the photo detecting element, again, and the photo coupler is changed to the on-state. The photo couplers of the associated set are sequentially changed to the on state on the way to the rest position of the associated black/white key. Thus, the optical transducer changes the plural photo couplers between the on-state and the off-state depending upon the current position of the associated black/white key so that the key position is determinable on the basis of the output signals of the set of photo couplers.

A problem is encountered in the prior art optical position transducers in the installation work. The installation work is complicated. First, the assembling worker seeks a proper position on the reverse surface of each black/white key where the shutter plate is moved on a target trajectory in the detectable range of the photo-coupler. This work is hereinbelow referred to as "alignment work". Subsequently, the assembling worker secures the shutter plate to the proper position with a suitable tool. This work is hereinbelow referred to as "fixing work". The optical position transducer, i.e., the combination of photo couplers and shutter plate monitors only one black/white key. Eighty-eight black/white keys are usually incorporated in the keyboard of a standard acoustic piano. This means that the manufacturer repeats the two kinds of works, i.e., the alignment work and fixing work for the eighty-eight optical position transducers.

In detail, the space between the black/white keys and the key bed is so narrow that the worker can not carry out the alignment work under the black/white keys. The worker mounts the array of optical transducers on the key bed, and secures the array of optical transducers at a certain position under the black/white keys. The worker picks up the individual black/white keys, and temporarily attaches the shutter plates onto the reverse surfaces of the individual black/white keys. The worker puts the individual black/white keys on the balance rail, and checks each optical position transducer to see whether or not the shutter plate passes the gap between the light emitting elements and the photo detecting elements. If the answer is positive, the worker picks up the individual black/white keys, again, and fixes the shutter plates to the associated black/white keys with nails. If a shutter plate is deviated from the target trajectory, the worker removes the shutter plate from the reverse surface, and moves the shutter plate aside. The worker checks the shutter plate for the trajectory, again. Thus, the worker seeks the proper position in the trial-and-error manner, and nails or tacks the shutter plate to the proper position. A tool is required for the fixing work. The worker picks up the tool, puts a nail or tack onto the shutter plate, and hits it with the hammer. The worker is to repeat the fixing work eighty-eighth times. Thus, the installation work is time-consuming, and makes the production cost of the composite keyboard musical instrument increased.

Even if the worker makes the shutter plates aligned with the photo-couplers with the assistance of a suitable jig, the worker still fixes the individual shutter plates to the black/white keys by means of the nails. The fixing work, i.e., nailing the shutter plates to the associated keys is time-consuming, and the manufacturer suffers from a great cost of the installation.

SUMMARY OF THE INVENTION

It is therefore an important object of the present invention to provide an optical position transducer which a worker easily installs in a system.

It is another important object of the present invention to provide a keyboard musical instrument in which the optical position transducers are installed for acquiring pieces of music data information.

In accordance with one aspect of the present invention, there is provided an optical position transducer for converting a current position of a moving object to an electric signal comprising an optical device having an output port and an input port for a light beam and converting the light beam incident on the input port to electric current, an optical modulator for modifying an optical intensity of the light beam depending upon a relative position to the optical device, a locator formed in the moving object at a proper position where the moving object causes the optical modulator to be moved along a target trajectory crossing the light beam, and a coupler connected between the locator and the optical modulator.

In accordance with another aspect of the present invention, a keyboard musical instrument for generating tones on the basis of pieces of music data information representative of attributes of the tones to be generated comprising plural series combinations of links selectively actuated for specifying the tones, plural vibratory members associated with the plural series combinations of links and energized by the associated series combinations of links for generating the tones and an electric system including an array of position transducers monitoring the plural series combinations of links for generating positional signals representative of current positions of the plural series combinations of links, each of the position transducers has an optical device having an output port and an input port for a light beam and converting the light beam incident on the input port to one of the positional signals, an optical modulator for modifying an optical intensity of the light beam depending upon a relative position to the optical device, a locator formed in one of the links of the associated series combination at a proper position where the aforesaid one of the links causes the optical modulator to be moved along a target trajectory crossing the light beam and a coupler connected between the locator and the optical modulator, and the electric system further includes a data processing sub-system connected to the optical devices respectively associated with the plural series combinations of links and analyzing the positional signals for producing music data codes representative of the tones to be generated and a converter connected to the data processing sub-system, and generating the tones on the basis of the music data codes.

BRIEF DESCRIPTION OF THE DRAWINGS

The features and advantages of the optical position transducer, optical filter and musical instrument will be more clearly understood from the following description taken in conjunction with the accompanying drawings, in which.

DESCRIPTION OF THE PREFERRED EMBODIMENTS

First Embodiment

Composite Musical Instrument

Figure 1:
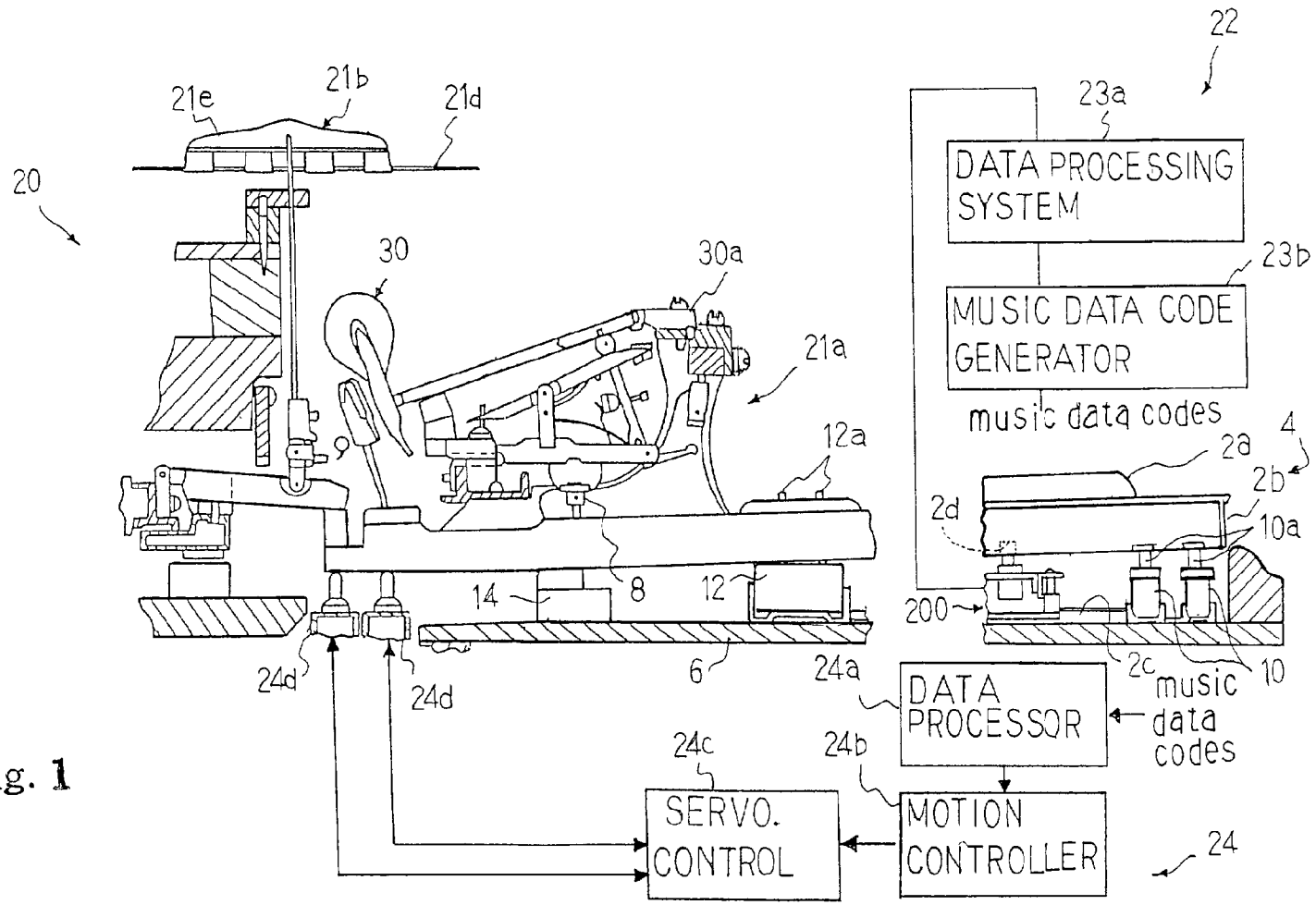
FIG. 1 is a schematic side view showing the structure of an automatic player piano according to the present invention.

Optical transducers according to the present invention are available for the composite musical instrument. An automatic player piano is an example of the composite keyboard musical instrument, and is hereinbelow described with reference to FIG. 1. In the following description, word "front" is indicative of a side near to the player of the musical instrument and word "rear" is indicative of a side far from the player of the musical instrument. Word "fore-and-aft direction" is the direction in which black keys and white keys generally extend from the rear side to the front side. Word "lateral" is indicative the direction crossing the line of the general arrangement of black/white keys in the standard acoustic piano. In other words, the lateral direction crosses the fore-and-aft direction at 90 degrees, respectively.

The automatic player piano embodying the present invention largely comprises an acoustic piano 20, a recording system 22 and an automatic playing system 24. The acoustic piano 20 is a standard grand piano, and comprises a keyboard 4 including black and white keys 2*a*/2*b*, the total number of which is eighty-eight, action units 21*a*, dampers 21*b*, strings 21*c* and hammer assemblies 30. The eighty-eight black/white keys 2*a*/2*b* are respectively linked with the action units 21*a*, which in turn are associated with the hammer assemblies 30. The hammer assemblies 30 are associated with the strings 21*d*, respectively. The dampers 21*b* are also associated with the black/white keys, respectively. Pitch names of a scale are respectively assigned to the black/white keys 2*a*/2*b*, and the tones are generated from the strings 21*d* associated with the black/white keys 2*a*/2*b*, respectively. These component parts 21*a*, 21*b*, 21*c* and 30 are assembled into the grand piano 20 as follows.

The keyboard 4 is mounted on a key bed 6, which forms a part of a piano case. The keyboard further includes a key frame, 2*c*, a pair of front rails 10, a balance rail 12 and a back rail 14. The balance rail 12 laterally extends on the key bed 6. The pair of front rails 10 laterally extends on the key bed 6 on the front side of the balance rail 12, and the back rail 14 extends on the key bed in the lateral direction on the rear side of the balance rail 12. The balance rail 12, pair of front rails 10 and back rail 14 are connected to the key frame 2*c*.

Balance pins 12*a* project from the balance rail 12, and are arranged on the balance rail 12 in the lateral direction at intervals. Through-holes are vertically formed in the black and white keys 2*a*/2*b*, and the balance pins 12*a* pass through the through-holes of the associated black/white keys 2*a*/2*b*. The balance pins 12*a* prohibit the associated black/white keys 2*a*/2*b* from lateral sliding, and permit the associated black/white keys 2*a*/2*b* to rotate about the balance rail 12.

Pairs of front pins 10*a* upwardly project from the front rails 10, and are respectively associated with the black/white keys 2*a*/2*b*. Pairs of recesses are formed in the front portions of the black/white keys 2*a*/2*b*, and are open to the pairs of front pins 10*a*, respectively. The pairs of recesses permit the associated front pins 10*a* to project thereinto. The pairs of front pins 10*a* prohibit the associated black/white keys 2*a*/2*b* from lateral sliding. When a pianist depresses the black/white key 2*a*/2*b*, the front portion of the depressed key 2*a*/2*b* is sunk, and the pianist gives rise to rotation about the balance rail 12. The pair of front pins 10*a* guide the sinking key 2*a*/2*b* to the front rails 10.

Recesses 2*d* are formed in predetermined portions of the black/white keys 2*a*/2*b*, respectively, and are open to the space over the key bed 6. The recesses 2*d* serve as locators, which are also labeled with reference 2*d*. When the black/white keys 2*a*/2*b* are put on the balance rail 12, the recesses 2*d* are over the predetermined positions. The predetermined positions will be described in more detail in conjunction with optical position transducers according to the present invention.

Capstan screws 8 respectively project from the rear portions of the black/white keys 2*a*/2*b*, and are connected to the associated action units 21*a*, respectively. The action units 21*a* give rise to rotation of the associated hammers 30. The constitution of action units 21*a* is known to persons skilled in the art. For this reason, no further description on the action unit 21*a* is hereinbelow incorporated for the sake of simplicity.

The dampers 21*b* are also linked with the associated black/white keys 2*a*/2*b*, and the black/white keys 2*a*/2*b* have the dampers 21*b* spaced from and brought into contact with the strings 21*d*. While the dampers are being spaced from the associated strings 21*d*, the strings are allowed to vibrate. When the dampers 21*b* are brought into contact with the associated strings 21*d*, the dampers 21*b* absorb the vibrations so as to decay the tones. The constitution of the dampers is well known to the person skilled in the art, and detailed description is omitted for the sake of simplicity.

When a pianist exerts force on the black/white key 2*a*/2*b*, the force gives rise to rotation of the black/white key 2*a*/2*b*, and the rotating key 2*a*/2*b* actuates the associated damper 21*b* and the associated action unit 21*a*. The damper head 21*e* is upwardly lifted by the depressed key 2*a*/2*b*, and is spaced from the associated string 21*d*. The string 21*d* gets ready for vibrations. The action unit 21*a* forces the associated hammer assembly 30 to rotate about a shank flange rail 30*a*. When an escape from the hammer assembly 30 takes place in the action unit 21*a*, the action unit 21*a* energizes the hammer assembly 21*b* so that the hammer assembly 30 starts free rotation toward the associated string 21*d*. The hammer assembly 30 is brought into collision with the associated strings 21*d*, and rebounds thereon. The string 21*d* vibrates, and the tone is radiated from the vibrating string 21*d*. When the pianist releases the depressed key 2*a*/2*b*, the black/white key 2*a*/2*b* starts to return toward the rest position. The damper 21*b* and action unit 21*a* exert the self-weight on the black/white key 2*a*/2*b*, and the black/white key 2*a*/2*b* is rotated backwardly. The damper head 21*b* is brought into contact with the vibrating string 21*d*, and decays the vibrations and, accordingly, tone. Thus, the keyboard 4, i.e., the black/white keys 2*a*/2*b* are functionally connected to the associated action units 21*a* and dampers 21*b*, and the hammer assemblies 30 and dampers 21*b* cooperate with the action units 21*a* for generating vibrations in the strings 21*d*.

The recording system 22 comprises an array of key sensors 200, a data processing system 23*a* and a music data code generator 23*b*. The key sensor 200 is implemented by an optical position transducer according to the present invention. The eighty-eight black/white keys 2*a*/2*b* are monitored by the eighty-eight key sensors 200, and the key sensors 200 periodically supply position signals representative of current positions of the associated black and white keys 2*a*/2*b* to the data processing system 23*a*. The data processing system 23*a* fetches pieces of positional data information, i.e., the current positions stored in the position signals, and stores the pieces of positional data information in a working memory thereof The data processing system 23*a* analyzes the pieces of positional data information so as to specify the black keys 2*a* and/or white keys 2*b* depressed and released by a player and estimate the loudness of the tones to be produced through the vibrations of strings 21*c*. The data processing system 23*a* further determines the time at which each black/white key 2*a* or 2*b* is depressed or released. Thus, the data processing system 23*a* obtains pieces of music data information representative of the performance through the analysis on the pieces of positional data information. The pieces of music data information are output to the music data code generator 23*b* and the music data code generator 23*b* produces a set of music data codes, which is also representative of the performance, based on the pieces of music data information. The set of music data codes is stored in a suitable information storage medium such as, for example, a compact disc or floppy disc. Otherwise, the set of music data codes is supplied through a cable to another musical instrument so as to play it in a real time fashion.

The set of music data codes may be read out from the information storage medium. The music data codes are supplied to the automatic playing system 24 for reproducing the performance. The automatic playing system 24 selectively rotates the black keys 2*a* and white keys 2*b* without fingering.

The automatic playing system 24 includes a data processor 24*a*, a motion controller 24*b*, a servo-controller 24*c* and an array of solenoid-operated key actuators 24*d*. The solenoid-operated key actuators 24*d* are respectively provided under the rear portions of the black/white keys 2*a*/2*b*, and are equipped with built-in velocity sensors (not shown). The music data codes are successively supplied to the data processor 24*a*, and the data processor 24*a* instructs the motion controller 24*b* to project and retract the plungers of the solenoid-operated key actuators 24*d* through the servo-controller 24*c*. The servo-controller 24*c* determines a target plunger velocity and, accordingly, the magnitude of a driving signal. When the driving signal is supplied from the servo-controller 24*c* to a solenoid-operated key actuator 24*d*, the solenoid-operated key actuator 24*d* upwardly projects the plunger from the solenoid, and the built-in velocity sensor supplies a feedback signal to the servo-controller 24*c* for reporting the current plunger velocity. The servo-controller 24*c* compares the current plunger velocity with the target plunger velocity to see whether or not the magnitude of the driving signal is appropriate. If the answer is given negative, the servo-controller 24*c* changes the magnitude of the driving signal.

The music data codes are classified into two categories. The music data codes in the first category store pieces of music data information representative of a kind of event such as a note-on event and a note-off event, the key code representative of the black keys 2*a* or white keys 2*b* to be rotated, the velocity, i.e., the loudness of the tone to be generated and so forth. The music data codes in the second category store control data information representative of a lapse of time from the initiation of a performance at which the event occurs.

Assuming now that a music data code indicates the time at which the associated note-on event is to occur, the data processor 24*a* specifies one of the black keys 2*a* and white keys 2*b* to be rotated on the basis of the key code, and determines a trajectory for the black keys 2*a* and white key 2*b*. The data processor 24*a* informs the motion controller 24*b* of the time t to start the rotation and the initial velocity Vr, i.e., coordinate (t, Vr). The motion controller 24*b* determines a series of coordinates on the trajectory, and sequentially supplies the target velocity to the servo-controller 24*c*. The servo-controller 24*c* determines the magnitude of the driving signal, and supplies the driving signal to the associated solenoid-operated key actuator 24*d*. With the driving signal, the solenoid creates the magnetic field, and upwardly projects the plunger. The plunger pushes the rear portion of the associated black keys 2*a* or white keys 2*b*. The plunger gives rise to the rotation of the black keys 2*a* or white key 2*b* around the balance rail 12, and the black key 2*a* or white key 2*b* thus pushed by the plunger spaces the damper 21*c* from the string 21*d*. The capstan 8 actuates the associated action mechanism 21*a*, and the hammer 30 is driven for the free rotation through the escape. The hammer 30 strikes the associated string 21*d* at the end of the free rotation, and the string 21*d* vibrates so as to generate the tone. The above-described function is repeated for selected black keys 2*a* and white keys 2*b* for reproducing the tones in the original performance. Thus, the automatic playing system 24 plays a piece of music without any fingering on the keyboard 4.

The automatic playing system 34 is same as that incorporated in a standard automatic player piano. The recording system 22 is similar to the recording system of the standard automatic player piano except the key sensors 200. For this reason, description is hereinbelow focused on the array of the key sensors 200.

Figure 2:
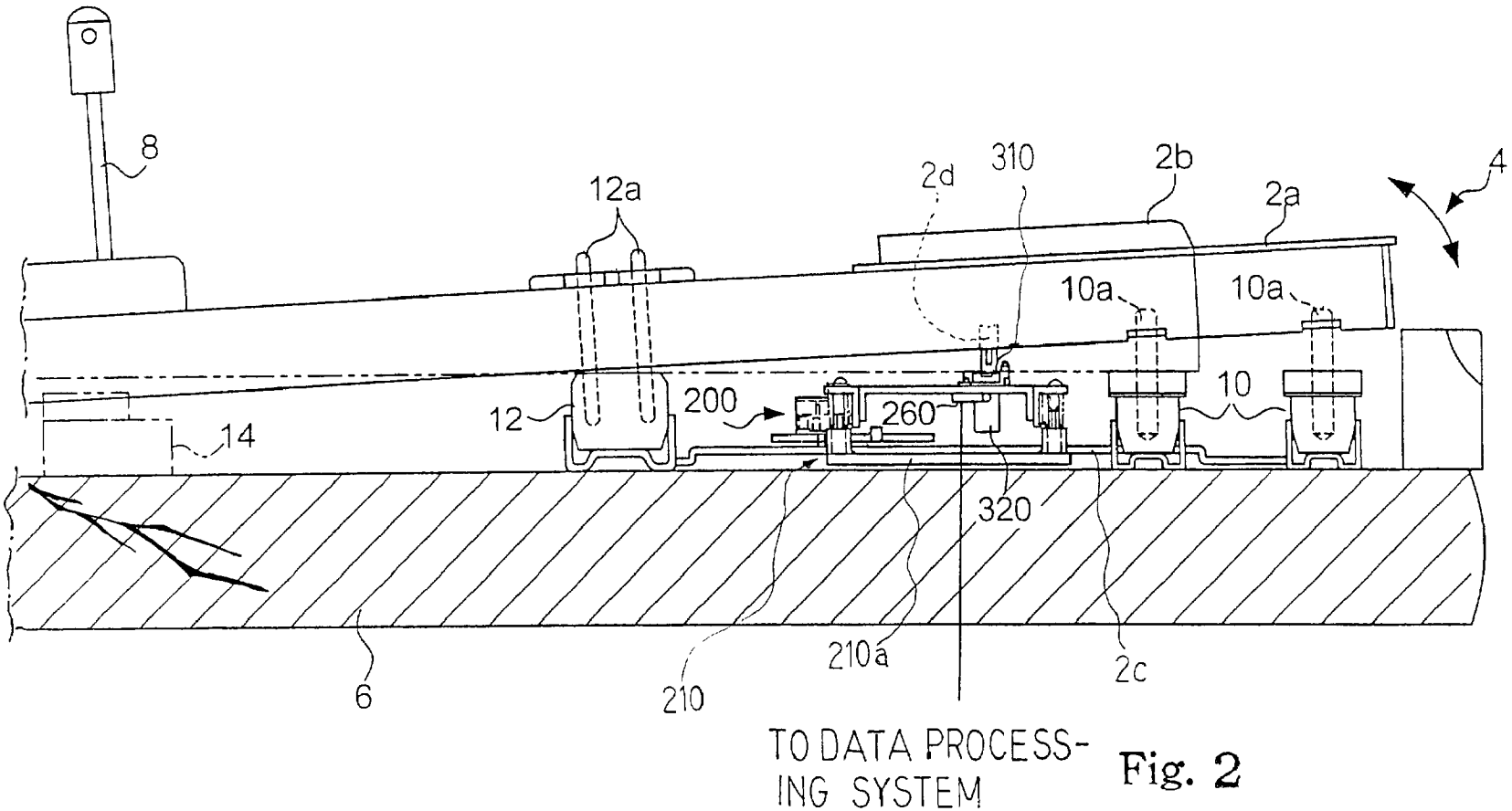
FIG. 2 is a side view showing an array of key sensors incorporated in the automatic player piano.

FIG. 2 illustrates the relation between the array of key sensors 200 and the keyboard 4. The array of key sensors 200 is provided in the narrow space between the black/white keys 2*a*/2*b* and the key bed 6. The array of key sensors 200 includes a supporting frame 210, photo-couplers 260, elastic couplers 310 and optical filters 320. Reference numeral 200 designates the array of key sensors. Each of the key sensors or key sensor unit is hereinafter labeled with reference "200*a*".

The supporting frame 210 is located at an appropriate position between the pair of front rails 10 and the balance rail 12, and is secured to the frame 2*c*. The area where the supporting frame 210 occupies is under the predetermined portions of the black/white keys 2*a*/2*b* already placed on the balance rail 12. The supporting frame 210 is long enough to occupy the space under the predetermined portions of the black/white keys 2*a*/2*b*, and is formed with slits. The slits are arranged at intervals in the lateral direction, and are aligned with the recesses 2*d*. The photo-couplers 260 are secured to the reverse surface of the supporting frame 210 in the vicinity of the slits, and the optical filters 320 are fixed to the black/white keys 2*a*/2*b* by means of the elastic couplers 310. Although the elastic couplers 310 remain separated from the black/white keys 2*a*/2*b* in FIG. 2, the optical filters 320 have been already secured to the elastic couplers 310. When the elastic couplers 310 are engaged with the locators 2*d*, the optical filters 320 are automatically aligned with the slits. The elastic couplers 310 are elastically coupled to the locators 2*d* of the black/white keys 2*a*/2*b* so that the black/white keys 2*a*/2*b* hold the optical filters 320 at the proper positions, respectively, as will be hereinafter described in more detail. The optical filters 320 respectively pass through the slits, and are moved together with the associated black/white keys 2*a*/2*b* after being secured to the associated black/white keys 2*a*/2*b*.

Optical Position Transducer

Figure 3:
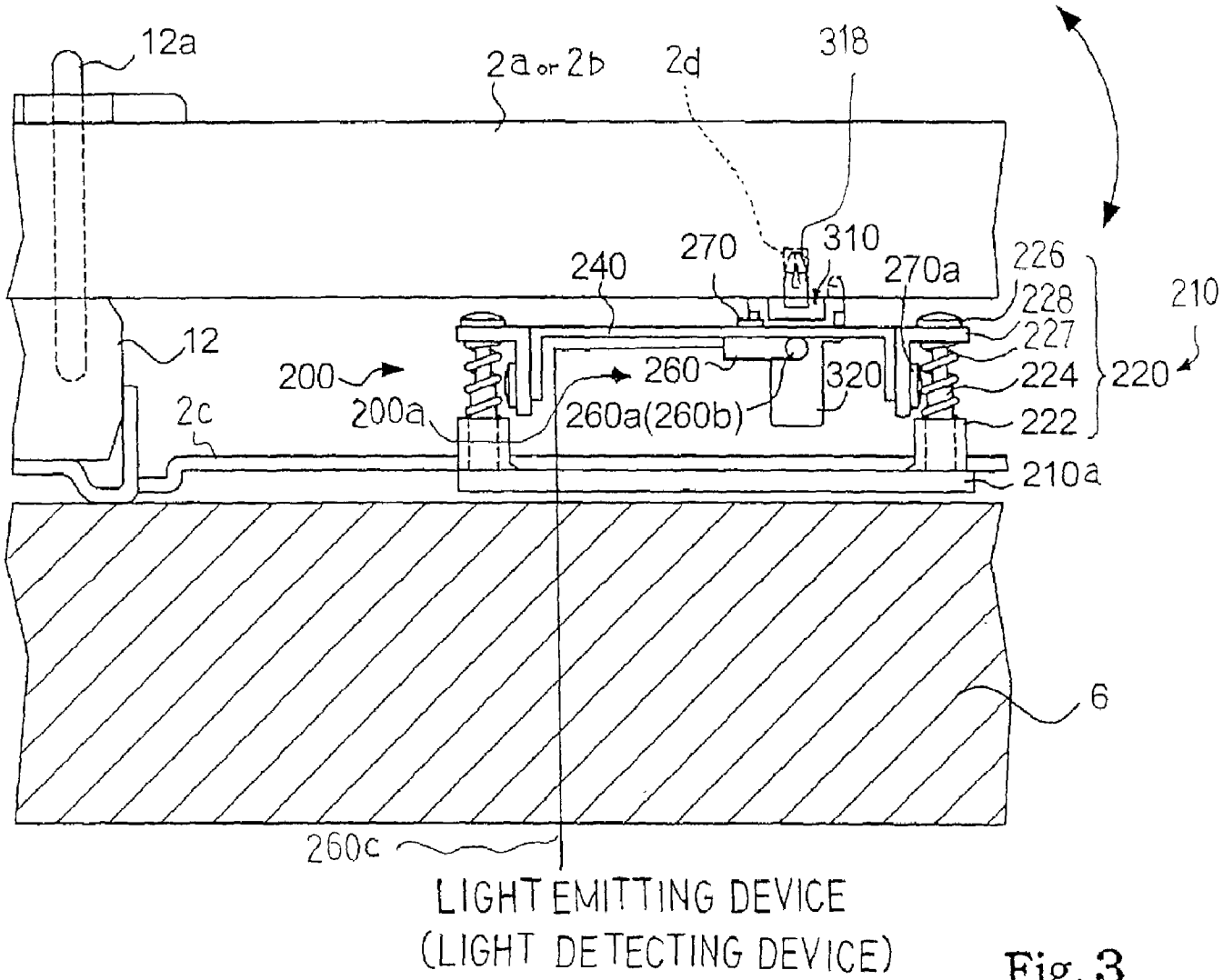
FIG. 3 is a side view showing the structure of a key sensor forming a part of the array.

FIG. 3 shows the key sensor unit 200*a* coupled to one of the black/white keys 2*a*/2*b* together with the supporting frame 210. The supporting frame 210 includes a base plate 210*a*, an adjuster 220 and a top plate 240. The base plate 210*a* is secured to the key frame 2*c*, and the top plate 240 is supported by the base plate 210*a* through the adjuster 220. The slits are formed in the top plate 240, and the photo-coupler 260 is fixed to the reverse surface of the top plate 240 by means of bolts. The optical filter 320 is secured to the black/white key 2*a*/2*b* by means of the elastic coupler 310. The elastic coupler 310 is inserted into the recess 2*d*, and is elastically pressed to the inner surface defining the recess 2*d* so as to keep itself in the recess 2*d*.

The adjuster 220 is used for regulating the gap between the base plate 210*a* and the top plate 240 so that a tuning worker adjusts the photo-coupler 260 to a proper position with respect to the optical filter 320 already secured to the black/white key 2*a*/2*b*.

The adjuster 220 has two adjuster units, which are provided on the front and rear sides of the top plate 240. The top plate 240 has a channel-like configuration, and the adjuster units are connected between the front and rear end portions of the top plate 240 and the front and rear end portions of the base plate 210*a*. A worker independently tunes the gap between the top plate 240 and the base plate 210*a*. Thus, the top plate 240 and, accordingly, the photo couplers 260 can take any attitude with respect to the optical filters 320 by virtue of the adjuster units.

The adjuster units are identical in structure with one another, and the adjuster unit on the front side is hereinbelow described in detail. The adjuster unit includes columns 222, spring sheet blocks 224, bolts 226, coil springs 227 and an angle bar 228. The angle bar 227 is secured to the front portion of the channel-shaped top plate 240 by means of rivets 270*a*. Bolt holes are formed in the angle bar 228, and are laterally spaced. The columns 222 are fixed to or integral with the base plate 210*a*, and are also laterally spaced. The spring sheet blocks 224 are partially embedded into the columns, and the coil springs 227 are engaged with the upper portions of the spring sheet blocks 224. The upper portions of the nuts 224 are snugly received into the coil springs 227, and the coil springs 227 are upright on the columns 222. Holes are vertically formed in the spring sheet blocks 224, and internal threads are formed on the inner surfaces defining the holes. The bolts 226 pass the bolt holes, and are screwed into the spring sheet blocks 224. The bolts 226 are screwed into the spring sheet blocks 224. Then, the angle bar 228 and, accordingly, the front side portion of the top plate 240 are downwardly urged against the elastic force of the coil springs 227. The bolts 226 are loosened. Then, the coil springs 227 push the angle bar 228 and the front portion of the top plate 240, upwardly. Thus, a worker regulates the gap between the top plate 240 and the base plate 210*a* by turning the bolts 226.

Each of the photo-couplers 260 is implemented by a light emitting element 260*a* and a light detecting element 260*b*. In this instance, optical sensor heads are used as the light emitting element 260*a* and light detecting element 260*b*. The optical sensor heads are arranged in the lateral direction, and are bolted to the top plate 240 in such a manner as to be altered with the slits. The optical sensor heads are connected through pairs of optical fibers 260*c* to light emitting/light detecting devices. The light emitting device periodically radiates light, and the light is propagated through the optical fibers 260*c* to the light output ports of the optical sensor heads. Light beams are radiated from the output ports of the optical sensor heads through the optical filters 320 to the light input ports of the adjacent optical sensor heads, and the incident light are propagated through the optical fibers 260*c* to the light detecting devices.

The elastic couplers 310 hold the optical filters 320, respectively, and have respective expanders 318. The expanders 318 are inserted into the recesses 2*d*, and are pressed to the inner surfaces defining the recesses 2*d*. Thus, the elastic couplers 310 are elastically coupled to the black/white keys 2*a*/2*b* so that the optical filters 320 are hung from the black/white keys 2*a*/2*b*.

As described hereinbefore, the optical filters 320 pass the slits formed in the top plate 240, and are moved together with the associated black/white keys 2*a*/2*b*. The trajectories of the optical filters 320 are across the optical paths for the light beams at right angles. A wedge pattern 322 is printed on a transparent flexible plate (see FIG. 4). The wedge pattern 322 is non-transparent so that the amount of light passing through the optical filter 320 is varied together with the downward motion of the optical filter 320. In this instance, the transparent flexible plate is made of PET (Poly-Ethylene Terephthalate). The optical filter 320 is fit to the elastic coupler 310, and is secured thereto.

The array of key sensors 200 is installed as follows. First, a worker removed the black/white keys 2*a*/2*b* from the acoustic piano 20. The worker machines the black/white keys 2*a*/2*b* for forming the locators or recesses 2*d*. The machining is so accurate that the worker can exactly form the recesses 2*d* at proper positions where the optical filters 320 are aligned with the slits when the black/white keys 2*a*/2*b* are placed on the balance rail 12.

The worker fixes the supporting frame 210 to the proper position on the key frame 2*c*. The supporting frame 210 at the proper position has the slits just under the locators 2*d*. The worker selectively turns the bolts 226, and regulates the height of the photo-couplers 260 to a predetermined value.

Subsequently, the worker secures the optical filters 320 to the elastic couplers 310, respectively. The worker forcibly inserts the expanders 318 into the recesses 2*d*. The expanders 318 are elastically deformed, and are advanced deep into the recesses 2*d*. The worker releases the elastic couplers 310 from his or her hand. Then, the expanders 318 are elastically pressed to the inner surfaces defining the recesses 2*d*, and the elastic couplers 310 are secured to the black/white keys 2*a*/2*b*. The worker assembles the black/white keys 2*a*/2*b* with the balance pins 12*a* and front pins 10*a*, and passes the optical filters 320 through the slits. Thus, the worker exactly locates the optical filters 320 at the proper position, and quickly assembles the array of key sensors 200 with the black/white keys 2*a*/2*b*. Any tool such as a hammer is not required for the optical filters 310. The assembling work is speedy, and the manufacturer reduces the production cost.

The key sensor 200*a* behaves as follows. Assuming now that a pianist is recording his or her performance through the recording system 22, the pianist selectively depresses and releases the black/white keys 2*a*/2*b*, and the array 200 of key sensors 200 supplies the key position signals to the data processing system 23*a*. The light beam passes through the transparent below the wedge pattern 322. While the pianist is fingering the tune, he or she depresses the black/white key 2*a*/2*b* shown in FIGS. 3, and the front portion of the black/white key 2*a*/2*b* is sunk toward the front rails 10. The optical filter 320 starts to go down. The wedge pattern 322 enters the light beam, and interrupts the light beam. The area interrupted with the wedge pattern 322 is gradually increased, and the amount of light incident on the light detecting element 260*b* is decreased. The amount of photo current is varied proportionally to the amount of incident light. Thus, the key sensor 260*a* converts the key position to the amount of photo current. The key position signal is produced from the photo current, and is representative of the current key position.

Figure 4:
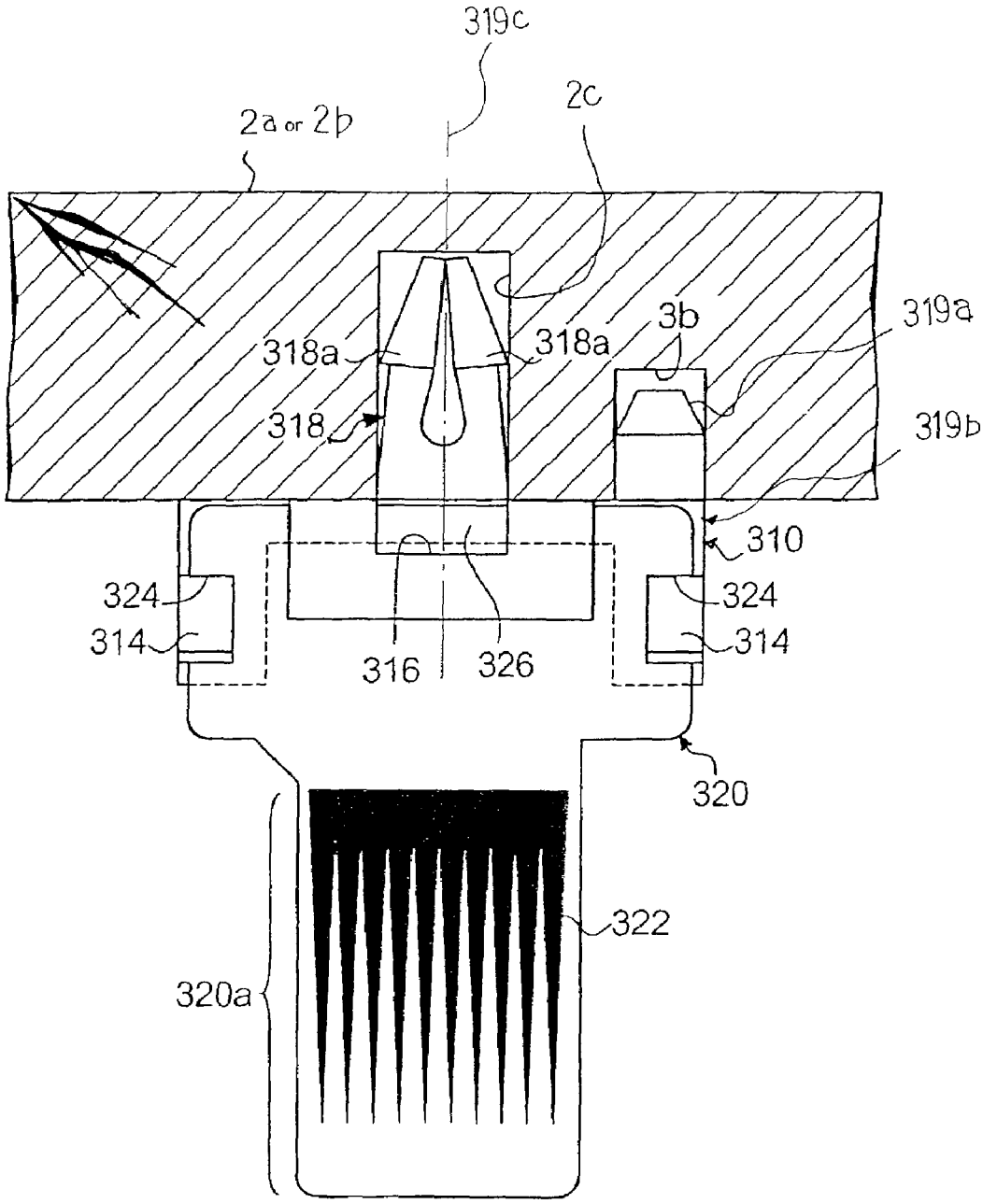
FIG. 4 is a side view showing an optical filter and an elastic coupler incorporated in the key sensor.

FIG. 4 illustrates the elastic coupler 310 embodying the present invention. The elastic coupler 310A is elastically coupled to the black/white key 2*a*/2*b*, and holds the optical filter 320 under the black/white key 2*a*/2*b*. The optical path extends in the lateral direction between the light emitting element 260*a* and light detecting element 260*b*. The optical filter 320 is held under the black/white key 2*a*/2*b* in parallel to the fore-and-aft direction. Then, the optical path crosses the optical filter at right angles.

The elastic coupler 310A is broken down into the expander 318, an anchor 319*a* and a retainer 319*b*. The optical filter 320 is fitted to the retainer 319*b*. The retainer 319*b* and expander 318 are symmetrical with respect to line 319*c*. The expander 318 and anchor 319*a* upwardly project from the retainer 319*b*, and are fixed to or integral with the retainer 319*b*. The expander 318 is located at the center of the retainer 319*b*, and the anchor 319*c* is frontward spaced from the expander 318 by a predetermined distance. The expander 318 is elastically pressed to the inner surface defining the recess 2*c*, and prevents the elastic coupler 310 from falling from the black/white key 2*a*/2*b*. A recess 3*b* is further formed in the black/white key 2*a*/2*b*, and is spaced from the recess 2*c* by the predetermined distance. The anchor 319*b* is snugly received in the recess 3*b*, and prohibits the retainer 319*b* from turn about the line 319*c*.

The optical filter 10 is hung from the black/white key 2*a*/2*b* as follows. A worker firstly fits the optical filter 310 to the retainer 19*b*. Subsequently, the worker aligns the expander 318 and t2*c* and 3*b*, and thrusts the expander 318 and the anchor 319*a* into the recesses 2*c* and 3*b*. The expander 318 is elastically deformed, and advances toward the bottom of the recess 2*c*. When the expander 18 reaches the bottom, the worker removes the force from the elastic coupler 310. Then, the expander 318 is expanded, and is pressed to the inner surface defining the recess 2*c*. Thus, the optical filter 310 is elastically coupled to the black/white key 2*a*/2*b* by means of the elastic coupler 310.

Figure 5A:
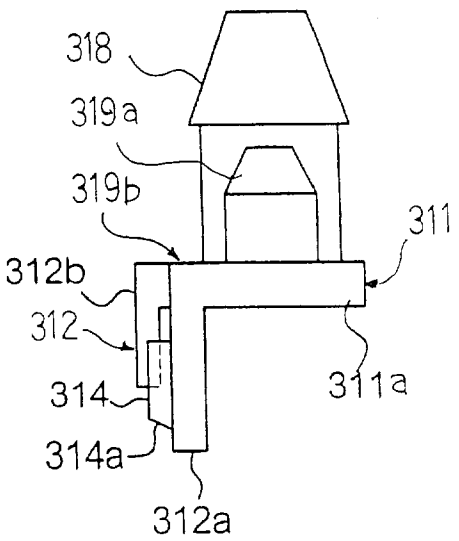
FIGS. 5A, 5B and 5C are a front view, a side view and a bottom view showing the constitution of the elastic coupler.
Figure 5B:
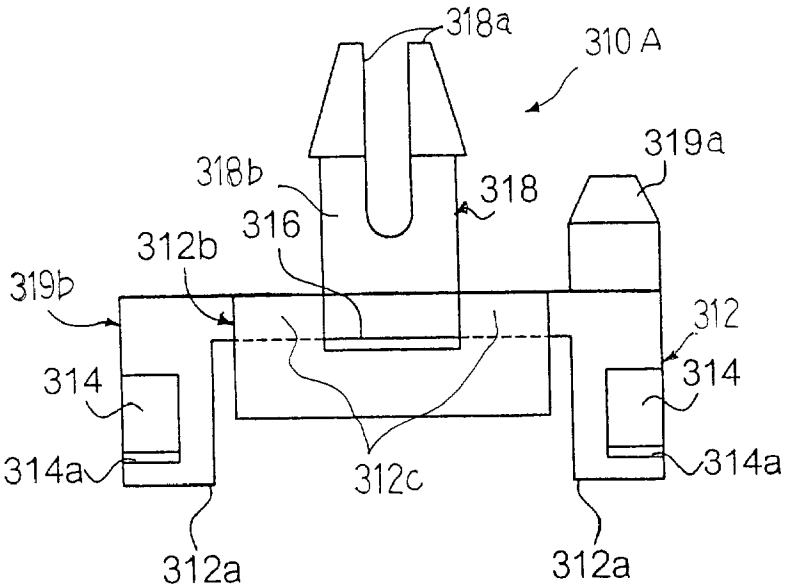
Figure 5C:
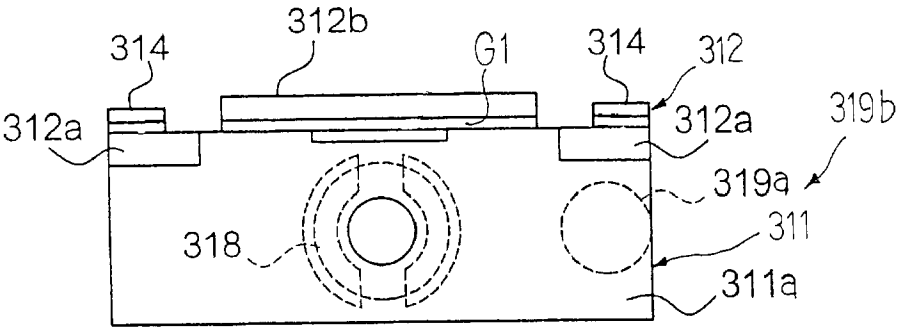

FIGS. 5A, 5B and 5C illustrate the elastic coupler 10A in more detail. The retainer 319*b* has a base plate 311 and a holder 312. The base plate 311 is elongated in the fore-and-aft direction. The base plate 311 is broken down into a flat portion 311*a* and a pair of wall portions 312*a*. The expander 318 and anchor 319*a* upwardly project from the major surface of the flat portion 311*a*. One of the wall portions, i.e., the front wall portion 312*a* downwardly projects from a front side portion of the flat portion 311*a*, and the other wall portion, i.e., the rear wall portion 312*a* downwardly projects from a rear side portion of the flat portion 311*a*. Thus, the front wall portion 312*a* is spaced from the rear wall portion 312*a* in the fore-and-aft direction.

The holder 312 is constituted by a center stopper 312*b* and a pair of end stoppers 314. The center stopper 312*b* is connected at front and rear end portions 312*c* thereof to the side surface of the flat portion 311*a*, and downwardly projects from the flat portion 311*a*. The center stopper 312*b* is partially cut out so that the side surface is exposed to an opening 316. The opening 316 makes the front and rear end portions 312*c* spaced from one another. The center stopper 312*b* is laterally spaced from the side surface, and a gap G1 takes place between the flat portion 311*a* and the center stopper 312*b*. The gap G1 is approximately equal to the thickness of the optical filter 320. The end stoppers 314 are provided on the front and rear wall portions 312*a*/312*b*, respectively, and sideward project therefrom. The end stoppers 314 have a thickness greater than the gap G1 so that the end stoppers 314 are partially overlapped with the center stopper 312*b* as seen in FIG. 5A. The end stoppers 314 have slopes 314*a*, which guide the optical filter 320 as will be hereinafter described in more detail.

Figure 6:
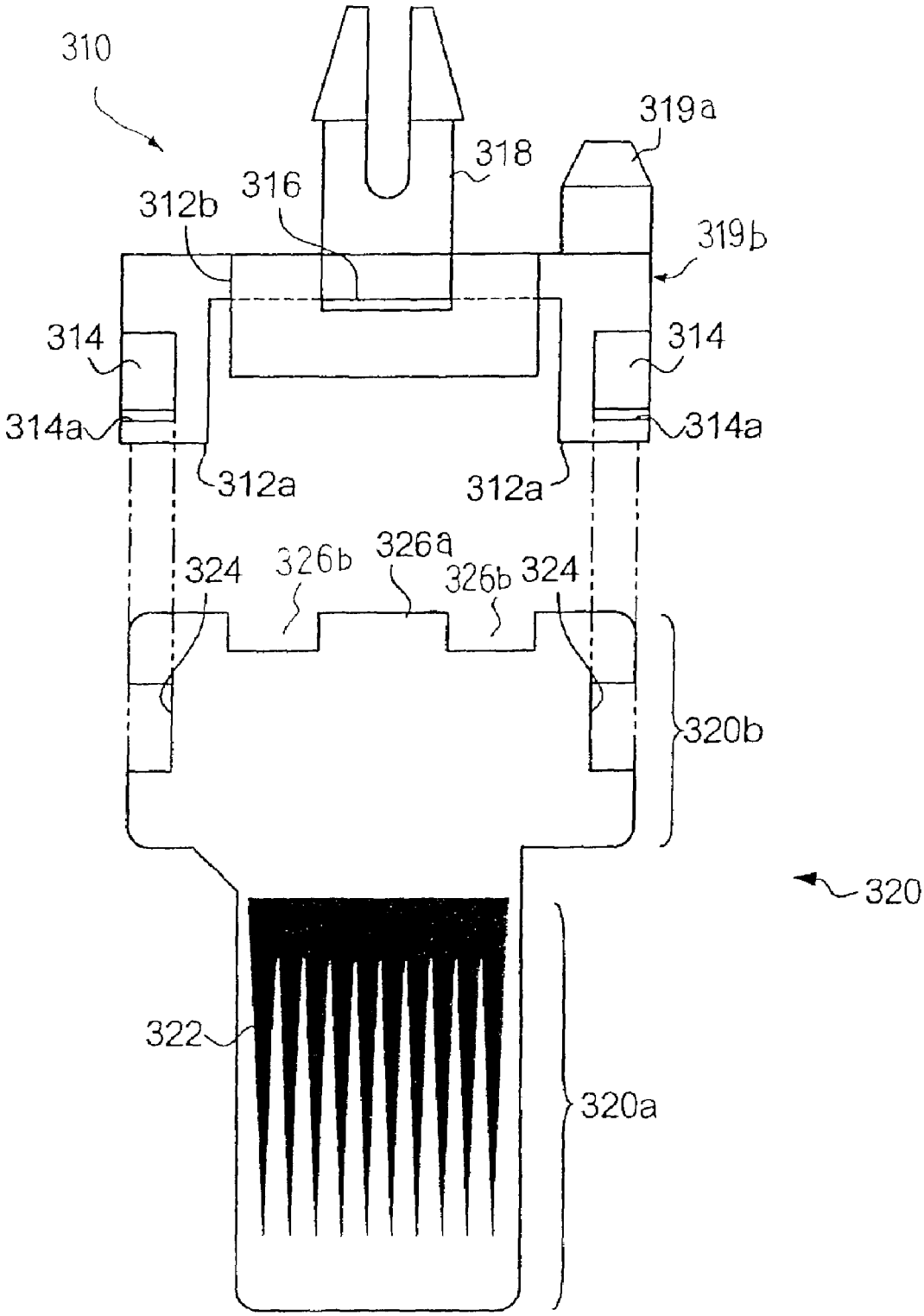
FIG. 6 is a side view showing the optical filter disassembled from the elastic coupler.

The center stopper 312*b* and end stoppers 314 are designed to adopt the optical filter 320. FIG. 6 shows the optical filter 320 separated from the elastic coupler 310. As described hereinbefore, the optical filter 320 has the wedge pattern 322 printed on the transparent flexible plate. The transparent flexible plate has a lower portion 320*a* and an upper portion 320*b*. The wedge pattern 322 is printed on the major surface of the lower portion 320*a*, and the upper portion 320*b* is partially cut out. Dents 326*b* and 324 are formed in the upper portion 320*b*. The dents 326*b* are formed along the upper edge of the transparent flexible plate, and the dents 324 are directed to the front side and rear side, respectively. The dents 326*b* have the length approximately equal to the front and rear end portions 312*c*, and the remaining portion 326*a* is as long as the opening 316. When a worker inserts the optical filter 320 into the retainer 311, the upper portion 320*b* is interdigitated with the center stopper 312*b*, and the remaining portion 326*a* is exposed to the opening 316. When the bottom edges of the dents 326*b* are brought into contact with the front and rear portions 312*c*, then the center stopper 312*b* does not permit the worker to move the optical filter 320 upwardly. Thus, the center stopper 312*b* sets an upper limit to the optical filter 320.

Although the dents 324 are corresponding to the end stoppers 314, the depth of the dents 324 is less than the width of the end stoppers 314. In other words, the upper portion 320*b* between the dents 324 is slightly wider than the gap between the end stoppers 314. The end stoppers 314 are respectively received into the dents 324 before the center stopper 312*b* prohibits the upper portion 320*b* from the upward motion of the optical filter 320. The upper portion 320*b* is slightly warped due to the difference, and is elastically pressed against the end stoppers 314. Thus, the upper portion 320*b* is not only clamped between the center stopper 312*b* and the end stoppers 314 but also elastically pressed to the end stoppers 314.

The optical filter 320 is secured to the elastic coupler 310 as follows. First, a worker pinches the optical filter 320, and brings the upper edge of the optical filter 320 into contact with the slopes 314*a*. The worker slides the upper portion 320*b* on the slopes 314*a* and the vertical side surfaces of the end stoppers 314. The upper portion 320*b* is brought into contact with the center stopper 12*b*. The worker presses the remaining portion 326 toward the base plate 311. Then, the remaining portion 326 is inserted into the gap G1. The worker pushes the optical filter 320 into the gap G1. The upper portion 320*b* further slides over the vertical side surfaces, and is interdigitated with the center stopper 312*b*. When the dents 324 reach the end stoppers 314*a*, the worker shrinks the upper portion 320*b* so as to fit the end stoppers 314 into the dents 324. The upper portion 320*b* is held between the center stopper 312*b* and the end stoppers 314.

When a worker disassembles the optical filter 320 from the elastic coupler 310, the worker deforms the upper portion 320*b* so as to disengage the end stoppers 314 from the dents 324, and pulls out the optical filter 320 from the elastic coupler 310. Thus, the optical filter 320 is easily assembled with and separated from the elastic coupler 310.

Turning back to FIGS. 5A to 5C, the expander 318 is broken down into a bifurcated boss portion 318*b* and a pair of wedge portions 318*a*. In this instance, the expander 318 is made of polyacetal (POM) or nylon. Any deformable material is available for the expander 318. The bifurcated boss portion 318*b* has a generally column configuration, and has a diameter approximately equal to the inner diameter of the cylindrical recess 2*c*. The wedge portions 318*a* upwardly projects from the bifurcated upper ends of the boss portion 318*b*. The wedge portions 318*a* have respective outer surfaces, and the distance between the outer surfaces is gradually decreased toward the leading ends. Although the maximum distance is greater than the diameter of the bifurcated boss portion 318*b*, the minimum distance is less than the diameter of the bifurcated boss portion 318*b* and the inner diameter of the cylindrical recess 2*c*. For this reason, when a worker inserts the expander 318 into the cylindrical recess 2*c*, the wedge portions 318*a* smoothly advance into the cylindrical recess 2*c* without any resistance. However, the wedge portions 318*a* are brought into contact with the inner surface defining the cylindrical recess 2*c* on the way to the bottom surface. The worker thrusts the expander 318 into the cylindrical recess 318 against the resistance. Then, the reaction is exerted on the outer surfaces of the wedge portions 318*a*, and makes the wedge portions 318*a* closer to one another. Thus, the distance between the outer surfaces is regulated to the inner diameter of the cylindrical recess 2*c* so as to permit the wedge portions 318*a* to advance toward the bottom of the cylindrical recess 2*c*. When the leading ends of the wedge portions 318*a* reach the bottom of the cylindrical recess 2*c*, the upper surface of the base plate 311 is brought into contact with the reverse surface of the associated black/white key 2*a*/2*b*, and the worker releases the elastic coupler 310 from his or her hand. The wedge portions 318*a* are elastically pressed to the inner surface of the cylindrical recess 2*c*, and prohibit the expander 318 from falling from the black/white key 2*a*/2*b*. Even though the optical filter 320 is hung from the elastic coupler 310, the total self-weight is too small to pull out the wedge portions 318*a* from the cylindrical recess 2*c* against the friction between the outer surfaces and the inner surface. Of course, if a worker strongly pulls the elastic coupler 318, the wedge portions 318*a* slide on the inner surface against the friction, and is taken out from the cylindrical recess 2*c*.

In the first embodiment, the photo-coupler 260 serves as an optical device, and the optical filter 320 is a sort of an optical modulator. Each of the black/white keys 2*a*/2*b*, associated action units 21*a* and associated hammer assembly 30 as a whole constitute a series combination of links, and the string 21*d* serves as a vibratory member. The recording system 22 and automatic playing system 24 form in combination an electric system, and the solenoid-operated actuators 24*d* serve as converters.

As will be understood from the foregoing description, the locator 2*d* is exactly formed in the black/white key 2*a*/2*b* through the machining, and makes the optical filter 320 already engaged with the elastic coupler 310 aligned with the slits. Moreover, the elastic coupler 310 according to the present invention is only pushed into the recess 2*c*. The Any tool is not required for the assembling work. The wedged portions 318*a* are pressed to the inner surface defining the recess 2*c*, and holds the base plate 311 in contact with the reverse surface of the associated black/white key 2*a*/2*b*. The locator 2*d* and elastic coupler 310 make the assemblage speedy so that the manufacturer reduces the production cost.

The black/white keys 2*a*/2*b* are made of wood. It is unavoidable that the wood is shrunk with time. The recesses 2*c* may be widened due to the aged deterioration. Even though the recess 2*c* is widened, the elastic coupler holds the optical filter 320 under the black/white key 2*a*/2*b*, because the elasticity still makes the wedge portions 318*a* pressed to the inner surface.

Moreover, the elastic coupler 310 holds the optical filter 320 by means of the holder 312. A worker pushes the flexible optical filter 320 into the gap G1 between the center stopper 312*b* and the end stoppers 314. The optical filter 320 is so flexible that the upper portion 320*b* slides over the end portions 314 and reaches the gap G1. Neither tool nor adhesive compound is not required for the assemblage. The assembling work is speedy, and the manufacturer reduces the production cost. The assembling work without adhesive compound is desirable, because the optical sensor heads are less contaminated during the assembling work.

Second Embodiment

Figure 7:
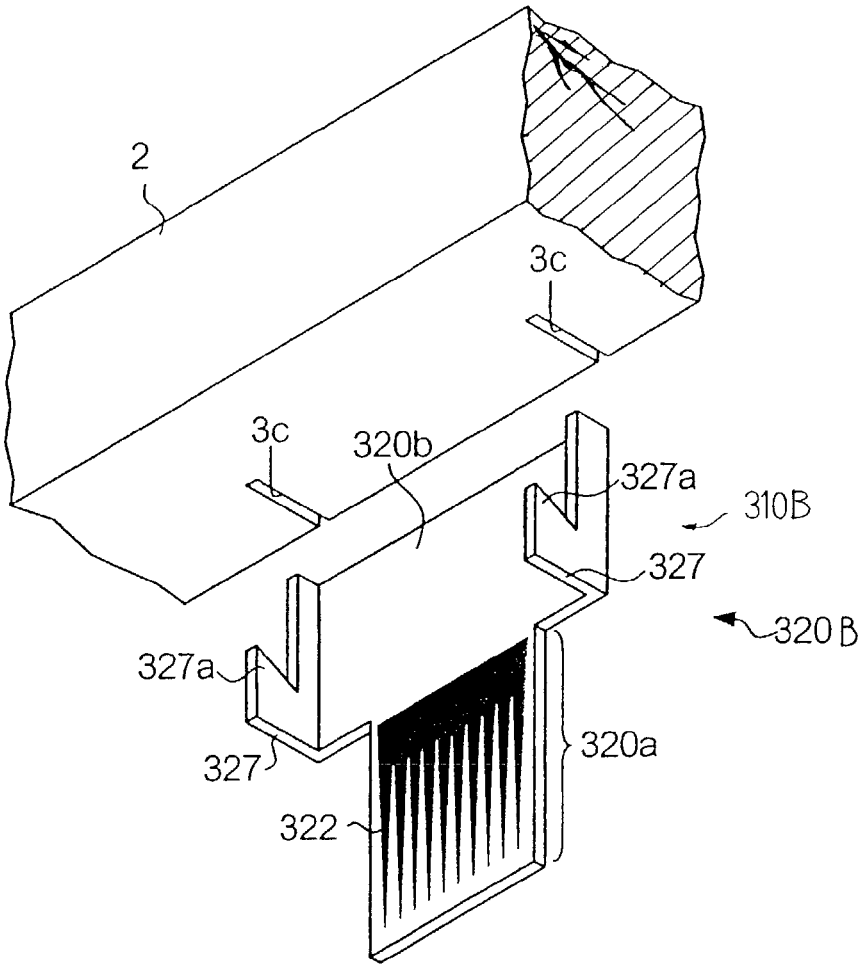
FIG. 7 is a perspective view showing an optical filter forming a part of another optical position transducer according to the present invention.
Figure 8:
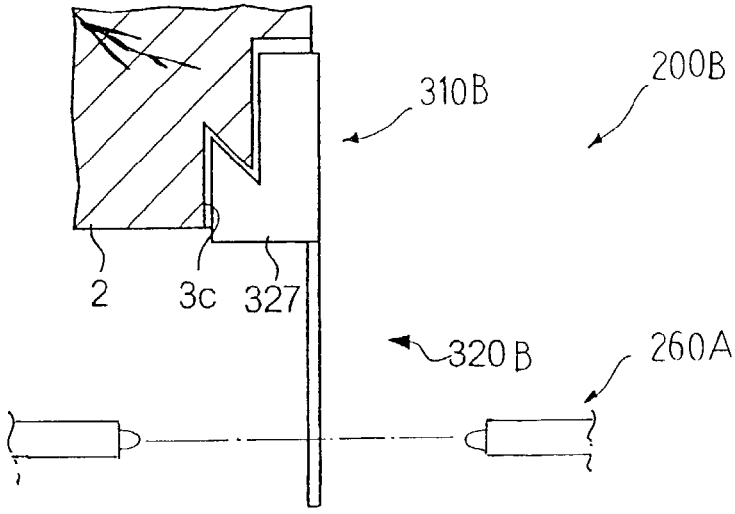
FIG. 8 is a cross sectional view showing the optical filter secured to one of the black/white keys incorporated in a composite keyboard musical instrument.

FIGS. 7 and 8 illustrate an optical filter 320B forming a part of another optical position transducer 200B embodying the present invention. The optical position transducer 200B is available for the composite keyboard musical instrument.

The optical position transducer implementing the second embodiment includes a photo-coupler 260A, a coupler 310B and the optical filter 320B. The photo-coupler 260 may be same as that in the optical position transducer 200*a*, i.e., the combination of a pair of optical sensor heads, optical fibers and light emitting/light detecting elements. In case where the optical position transducer 200B is used in an automatic player piano, the optical position transducer 200B serves as a key sensor unit, and the key sensor units may be secured to the reverse surface of the supporting frame 210.

The coupler 310B and the optical filter 320B are monolithic, and the monolithic body 310B/320B is formed of transparent substance such as synthetic resin. A piece of synthetic resin, which was cut out from a sheet of synthetic resin, may be given to the shape shown in FIG. 7.

The coupler 310B is an upper portion of the monolithic body. The upper portion has front/rear portions 327, which are bent at 90 degrees with respect to the remaining portion 320*b*. The front/rear portions 327 are formed with hooks 327*a*, respectively, and corresponding slits 3*c* are formed in a moving object such as a black/white key 2. The pair of slits 3*c* serves as a locator, and are exactly formed in the black/white key 2 through a machining. The slits 3*c* are given to a shape corresponding to the front/rear portions 327 so that the coupler 320B is snugly received in to the slits 3*c*. The coupler 310B is secured to the black/white key 320B with adhesive compound. The hooks 327*a* make the constant area between the coupler 310B and the black/white key 2 increased so that the coupler is strongly adhered to the black/white key 2.

The lower portion of the monolithic body serves as a transparent plate 320*a* where wedges 322 are laid on the pattern. The wedge pattern may be printed on the transparent plate 320*a* before or after the piece of synthetic resin was cut out from the sheet. It is preferable that the distance between the upper surface of the black/white key 2 and the upper edge of the monolithic body is greater than the stroke of the key 2. Even when a pianist depresses the adjacent key, the monolithic body 310B/320B is still under the depressed key, and is never seen by the pianist.

The optical position transducer 200B is assembled with the black/white key 2 as follows. The slits 3*c* has been already formed in the black/white key 2, and a piece of transparent synthetic resin has been shaped into the monolithic body 310B/320B. The depth of slits 3*c* is adjusted such that the optical path extends across a predetermined area in the optical filter 320B. A worker pinches the monolithic body 310B/320B, and spreads adhesive compound over the contact surface of the coupler 310B. The worker aligns the front/rear portions 327 with the slits 3*c*, and inserts the front/rear portions 327 into the slits 3*c*. When the adhesive compound is solidified, the black/white key 2 is placed on the balance rail.

In the second embodiment, the photo-coupler 260A serves as an optical device, and the optical filter 320B is a sort of an optical modulator.

As will be understood from the foregoing description, the worker assembles the monolithic body 310B/320B with the moving object by inserting the coupler already coated with the adhesive compound into the slits 3*c*. Any tool is not required for the assemblage. Since the slits 3*c* are formed at the proper position where the optical filter 320B is to be aligned with a target trajectory in the detectable range of the photo-coupler 260A, the worker easily finds the proper position on the reverse surface of the black/white key 2. The assembling work is speed-up. Thus, the optical position transducer 200B is conducive to the cost reduction.

Although particular embodiments of the present invention have been shown and described, it will be apparent to those skilled in the art that various changes and modifications may be made without departing from the spirit and scope of the present invention.

Figure 9:
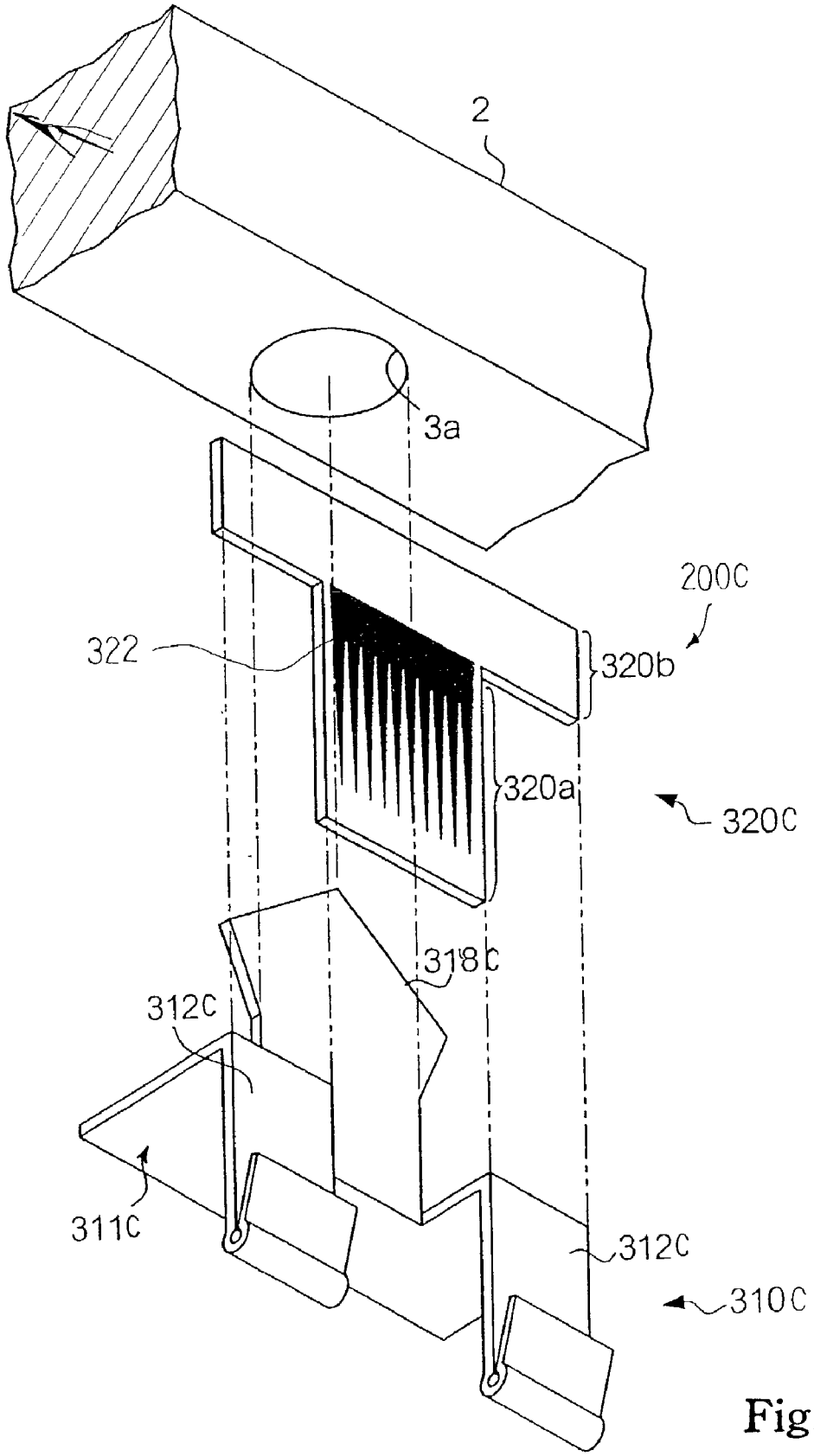
FIG. 9 is a perspective view showing a modification of the optical position transducer implementing the first embodiment.

FIG. 9 illustrates a modification of the first embodiment. The modification, i.e., an optical position transducer 200C includes an elastic coupler 310C, an optical filter 320C and a photo-coupler (not shown). The elastic coupler 310C is made from a metal plate such as, for example, an aluminum plate. The elastic coupler 310C may be formed of synthetic resin or rubber. The elastic coupler 310C is also broken down into an expander 318C and a retainer 311C. The expander 318C has a configuration like an arrowhead, and projects from the retainer 311C. The expander 318C is constant in width from the retainer 311C to an intermediate portion; the width is increased from the intermediate portion to a certain point, and is decreased to the tip. The constant width is approximately equal to the inner diameter of the cylindrical recess 3*a*, which is formed at a proper position on the reverse surface of a moving object such as a black/white key 2. This means that the expander 318C has the maximum width greater than the inner diameter. The retainer 311C is formed with a pair of hooks 312C. The hooks 312C downwardly project, and are spaced from each other by a predetermined distance.

The optical filter 320C is formed from a transparent plate, and is shaped like a tau cross. The tau cross-shaped optical filter 320C is broken down into a vertical portion 320*a* and a horizontal portion 320*b*. The wedge pattern 322 is formed on the vertical portion 320*a*. The vertical portion has a constant width less than the predetermined distance between the hooks 312C. The height of the horizontal portion 320*b* is not greater than the depth of the hooks 312C.

The optical filter 320C is held under the moving object 2 as follows. A worker firstly passes the vertical portion 320*a* through between the hooks 312C, and inserts the horizontal portion 320*b* into the gaps in the hooks 312C. The optical filter 310C is hung from the elastic coupler 320C. The upper edge of the horizontal portion 320*b* does not project over the retainer 311C. The worker aligns the expander 318C with the cylindrical recess 3*a*, and pushes the arrowhead thereinto. The arrowhead is warped, and slides into the cylindrical hole 3*a* until the retainer 311C is brought into contact with the reverse surface of the moving object 2. The arrowhead is not plastically deformed, but is elastically deformed. For this reason, the arrowhead is pressed to the inner surface of the moving object 2, and the elastic coupler 320C holds the optical filter 310C under the moving object 2. Any tool is not required for the assemblage. The cylindrical recess 3*a* has been already formed at the proper position where the optical filter 320C is to be aligned with a target trajectory so that the worker easily finds the proper position on the reverse surface of the moving object 2. The assembling work is speedy, and makes the production cost reduced.

Figure 10:
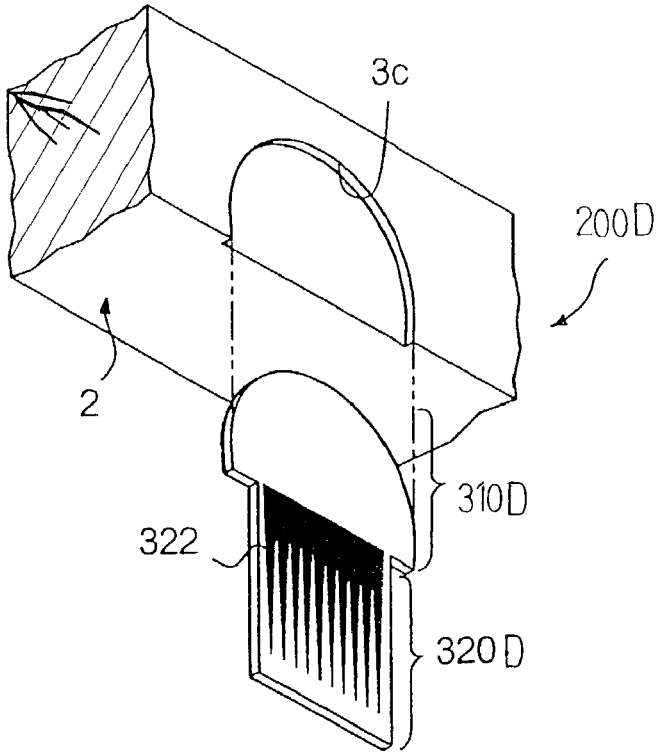
FIG. 10 is a perspective view showing a modification of the optical position transducer implementing the second embodiment.

FIG. 10 shows a modification of the second embodiment. The modification, i.e., an optical position transducer 200D includes a coupler 310D, an optical filter 320D and a photo-coupler (not shown). The coupler 310D and the optical filter 320D are monolithic. A transparent plate is shaped like a mushroom. The wedge pattern 322 is formed on the stem portion of the transparent plate, and a semi-circular head portion is corresponding to a semi-circular recess 3*c* formed on the side surface of a moving object 2 such as a black/white key. The semi-circular recess 3*c* is formed at a proper position where the optical filter 320D is to be aligned with a target trajectory. The semi-circular head portion serves as the coupler 310D, and is designed to be snugly received in the semi-circular recess 3*c*.

A worker assembles the monolithic body 320D/310D with the moving object as follow. The worker spreads adhesive compound over the semi-circular side surface of the head portion 310D or the semi-circular side surface of the moving object 2. The worker aligns the coupler 310D with the semi-circular recess 3*c*, and pushes the coupler 310D into the semi-circular recess 3*c*. The coupler 310D is pressed against the semi-circular side surface of the moving object 2 until the adhesive compound is solidified. Thus, the worker assembles the monolithic body with the moving object 2 without any tool. The semi-circular recess 3*c* has been already formed at the proper position where the optical filter 320D is to be aligned with the target trajectory so that the worker easily finds the proper position on the reverse surface of the moving object 2. The assembling work is speedy, and makes the production cost reduced.

Figure 11:
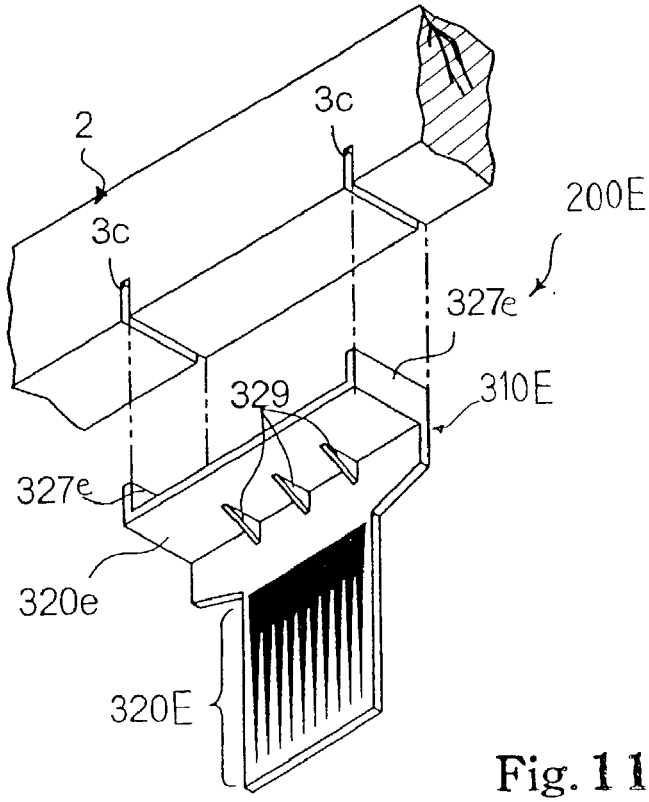
FIG. 11 is a perspective view showing another modification of the optical position transducer implementing the second embodiment.

FIG. 11 shows another modification of the second embodiment. The modification, i.e., an optical position transducer 200E includes a coupler 310E, an optical filter 320E and a photo-coupler (not shown). The coupler 310E and optical filter 320E are monolithic. The coupler 310E has a flat portion 320*e* and vertical wall portions 327*e*. The vertical wall portions 327*e* upwardly project from both ends of the flat portion 320*e*, and the optical filter 320E downwardly projects from a side surface of the flat portion 320*e*. Arms 329 keep the angle between the flat portion 320*e* and optical filter 310E at 90 degrees. Slits 3*c* are formed in the moving object 2, and are spaced from each other by a distance equal to the distance between the vertical wall portions 327*e*. The slits 3*c* are formed at a proper position on the reverse surface of the moving object 2. The vertical wall portions are as thin as the slits 3*c*, and the height of the vertical wall portions 327*e* is approximately equal to the depth of the slits 3*c*.

A worker assembles the monolithic body 310E/320E with the moving object 2 as follows. The worker spreads adhesive compound over the upper surface of the flat portion 320*c* and/or the reverse surface between the slits 3*c*. The adhesive compound may be further spread over the vertical wall portions 327*e*. The worker aligns the vertical wall portions 327 with the slits 3*c*, and pushes the vertical wall portions 327 into the slits 3*c* until the flat portion 320*c* is brought into contact with the reverse surface. The adhesive compound is solidified. Then, the monolithic body 310E/320E is secured to the moving object. The slits 3*c* have been already formed at the proper position where the optical filter 320E is to be aligned with a target trajectory so that the worker easily finds the proper position on the reverse surface of the moving object 2. Thus, any tool is not required for the assemblage. The assembling work is speedy, and makes the production cost reduced.

Figure 12:
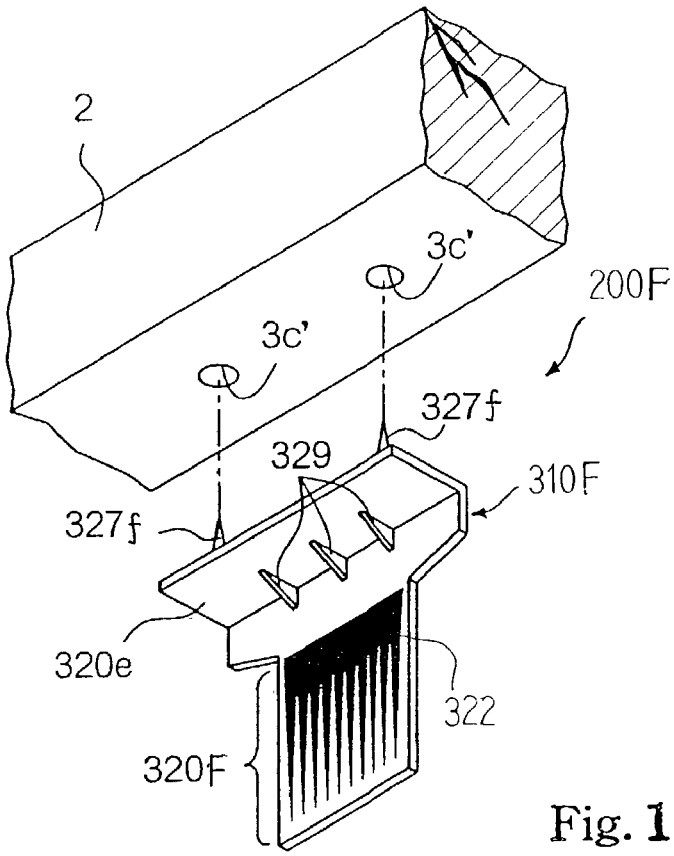
FIG. 12 is a perspective view showing yet another modification of the optical position transducer implementing the second embodiment.

FIG. 12 shows yet another modification of the second embodiment. The modification, i.e., the optical position transducer 200F includes a coupler 310F, an optical filter 320F and a photo-coupler (not shown). The coupler 310F and optical filter 320F are monolithic. The optical filter 320F is identical with the optical filter 320E, and the coupler 320F is similar to the coupler 320E except a pair of conical projections 327*f*. The vertical wall portions 327*e* are replaced with the conical projections 327*f*, and a pair of conical concaves 3*c*' are formed at a proper position on the reverse surface of the moving object 2.

In the assembling work, a worker spreads adhesive compound over the upper surface of the flat portion and/or the reverse surface. The adhesive compound may be further spread over the conical projections 327*f*. The worker aligns the conical projections 327*f* with the conical concaves 3*c*', and presses the monolithic body 310F/320F to the reverse surface of the moving object 2. The pair of conical concaves 3*c*' have been already formed at the proper position where the optical filter 320F is to be aligned with a target trajectory so that the worker easily finds the proper position on the reverse surface of the moving object 2. Any tool is not required for the assemblage. The assembling work is speedy, and makes the production cost reduced.

In the modifications of the second embodiment, the couplers 310E/310F may be further nailed or tacked to the moving object 2 after the solidification of the adhesive compound.

Figure 13:
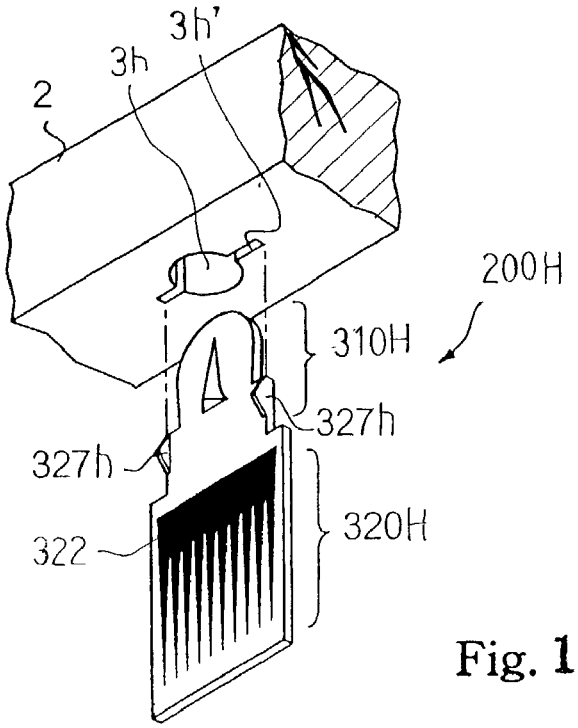
FIG. 13 is a perspective view showing another modification of the optical position transducer implementing the first embodiment.

FIG. 13 shows another modification of the optical position transducer implementing the first embodiment. The modification, i.e., the optical position transducer 200H includes a coupler 310H, an optical filter 320H and a photo-coupler (not shown). The coupler 310H and optical filter 320H are monolithic. The coupler 310H is generally semi-circular plate, and ribs 327*h* are formed at the both ends. The ribs 327*h* have claws, and the claws are rigid. A semi-spherical recess 3*h* and a pair of slits 3*h*' are formed at a proper position on the reverse surface of a moving object 2 or a black/white key, and the semi-spherical recess has a cross section corresponding to the semi-circular plate. The slits 3*h*' are corresponding to the ribs 327*h*.

The monolithic body 310H/320H is assembled with the moving object 2 as follows. A worker aligns the semi-circular plate and ribs 327*h* with the semi-spherical recess 3*h* and slits 3*h*', and pushes the coupler 310H thereinto. The claws lodge in the black/white key, and permit the elastic coupler 310H to be held in contact with the inner surface defining the semi-spherical recess. The claws are rooted to the inner surface, and prevents the monolithic body 310H/320H from falling down from the moving object 2. The semi-spherical recess 3*h* and slits 3*h*' have been already formed at the proper position where the optical filter 320H is to be aligned with a target trajectory so that the worker easily finds the proper position on the reverse surface of the moving object 2. Any tool is not required for the assemblage. The assembling work is speedy, and makes the production cost reduced.

A silent piano is well known to the skilled person as the composite keyboard musical instrument. Hammer sensors and/or key sensors are required for the silent piano, and the optical position transducer according to the present invention may be employed as the hammer/key sensors. The silent piano is the combination of an acoustic piano, a hammer stopper and an electronic tone generating system. When a user changes the hammer stopper to a free position, the hammer stopper is moved out of the trajectories of the hammers. While the user is fingering a piece of music on the keyboard, the depressed black/white keys give rise to free rotation of the hammers, and the hammers strike the associated strings so as to generate the piano tones. Thus, the silent piano behaves as an acoustic piano. The user is assumed to change the hammer stopper to the blocking position, the hammer stopper enters the trajectories of the hammers. After the entry into the blocking position, although the depressed key makes the action mechanism escape from the associated hammers, the hammers rebound on the hammer stopper before striking the string. Any piano tone is not generated from the string. Nevertheless, the electronic tone generating system produces electronic tones instead of the piano tones. The electronic tone generating system has an array of key sensors, a data processing system and a sound system. While the user is fingering a piece of music on the keyboard, the key sensors periodically report the current key positions of the associated black and white keys to the data processing system. The data processing system specifies the depressed keys and the released keys, and estimates the loudness of the tones. The data processing system stores these pieces of music data information in music data codes, and produces an audio signal from the music data codes. The audio signal is supplied to the sound system, and the sound system such as a headphone converts the audio signal to the electronic tones. Thus, the silent piano generates electronic tones instead of acoustic tones with the assistance of the key sensors. The silent piano may further have an array of hammer sensors for calculating the final hammer velocity accurately.

Figure 14:
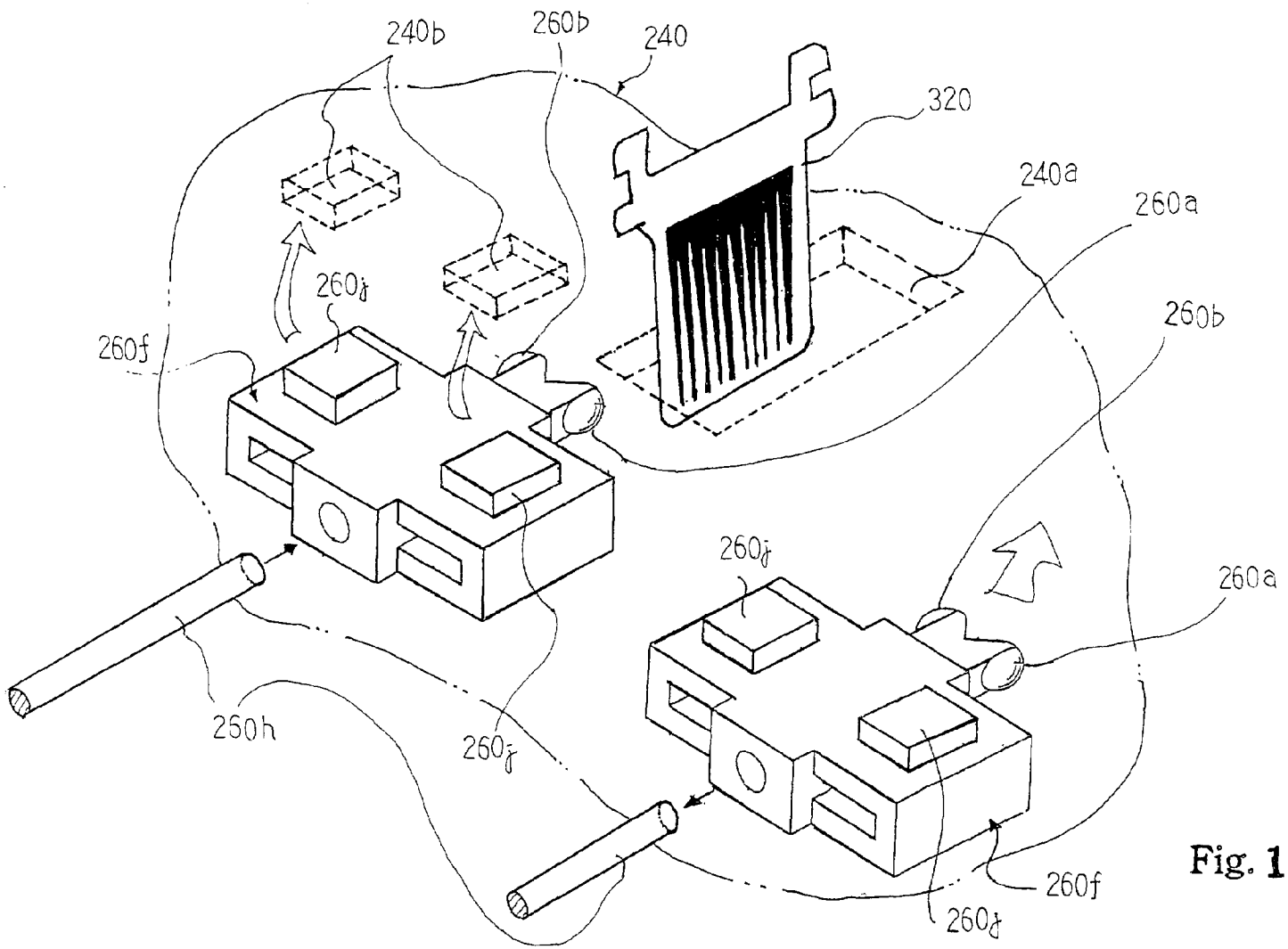
FIG. 14 is a perspective view showing a modification of sensor heads incorporated in the optical position transducer.

The photo-coupler 260 is constituted by sensor heads 260*f*, optical fibers 260*h* and light-emitting/light detecting elements (not shown) as shown in FIG. 14 The optical fibers 260*h* are connected between the light-emitting/light-detecting elements and the sensor heads 260*f*, and propagate light from the light-emitting elements to the output ports 260*a* and from the input ports 260*b* to the light-detecting elements. The light is sequentially supplied to the sensor heads 260*f* such that each sensor head 260*f* does not concurrently radiate and receive the light. When the left sensor head 260*f* radiates the light beam to the right sensor head 260*f*, the associated optical fiber 260*h* propagates the incident light from the right sensor head 260*h* to the light detecting element, and the light emitting element, which is connected to the same optical fiber 260*h*, is never energized during the propagation of the incident light from the right sensor head to the light detecting element.

A pair of rectangular parallelepiped projections 260*j* is formed on the upper surface of each sensor head 260*f*, and a pair of corresponding recesses 240*b* are formed in the top plate 240. The sensor head 260*f* is pressed to the reverse surface of the top plate 240 so that the rectangular parallelepiped projections 260*j* are snugly received into the corresponding recesses 240*b*. Thus, the sensor heads 260*f* are secured to the top plate 240 without any tool.

An optical filter may be replaced with an optical reflector. The optical reflector is secured to a moving object, and varies the amount of reflection depending upon the current position of the moving object. In this instance, a reflection type photo-coupler is used in association with the optical reflector.

The optical position transducer according to the present invention may serve as hammer sensors.

What is claimed is:

1. A keyboard musical instrument for generating tones on the basis of pieces of music data information representative of attributes of said tones to be generated, comprising:

plural series combinations of links respectively having plural keys, and selectively actuated by exerting force on said plural keys for specifying said tones;

plural vibratory members associated with said plural series combinations of links, and energized by the associated series combinations of links for generating said tones; and an electric system including an array of position transducers monitoring said plural keys for generating positional signals representative of current positions of said plural keys, each of the position transducers having an optical device having an output port and an input port for a light beam and converting said light beam incident on said input port to one of said positional signals, an optical modulator traveling on a predetermined trajectory for modifying an optical intensity of said light beam in proportion to a relative position of an associated one of said plural keys to said optical device and a coupler having a locating portion snugly received in a recess formed in said associated one of said plural keys so as to be held in abutting engagement with an inner surface defining said recess, thereby placing said optical modulator on said predetermined trajectory, said recess exposed through an opening on at least one of a lower surface and at least one side surface of said associated one of said plural keys, said coupler adhered to the inner surface so that said optical modulator is hung from said associated one of said plural keys, a data processing sub-system connected to the optical devices respectively associated with said plural series combinations of links and analyzing the relative positions of said plural keys expressed by said positional signals for producing music data codes representative of said tones to be generated, and a converter connected to said data processing sub-system, and generating said tones on the basis of said music data codes.

2. The keyboard musical instrument as set forth in claim 1, in which said plural series combinations of links further includes, plural action units respectively connected to said plural keys and hammers respectively driven for rotation by said plural action units.

3. The keyboard musical instrument as set forth in claim 2, in which said plural keys are associated with solenoid-operated key actuators incorporated in said electric system for selectively moving the associated keys without fingering by a human player.

4. The keyboard musical instrument as set forth in claim 1, in which said coupler and said optical modulator are a monolithic structure.

* * * * *